US010631093B2

(12) United States Patent
Moro

(10) Patent No.: US 10,631,093 B2
(45) Date of Patent: Apr. 21, 2020

(54) VENTED LOUDSPEAKER SYSTEM WITH DUCT FOR COOLING OF INTERNAL COMPONENTS

(71) Applicant: Harman International Industries, Inc., Stamford, CT (US)

(72) Inventor: Jerry Moro, Moorpark, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 802 days.

(21) Appl. No.: 14/605,111

(22) Filed: Jan. 26, 2015

(65) Prior Publication Data

US 2016/0219369 A1 Jul. 28, 2016

(51) Int. Cl.

| | |
|---|---|
| ***H04R 9/00*** | (2006.01) |
| ***H04R 9/02*** | (2006.01) |
| *H04R 1/28* | (2006.01) |

(52) U.S. Cl.

CPC ..... *H04R 9/022* (2013.01); *H04R 1/2842* (2013.01); *H04R 2201/028* (2013.01)

(58) Field of Classification Search

CPC ..... H04R 9/022
USPC ..... 381/355, 357, 358
See application file for complete search history.

(56) References Cited

U.S. PATENT DOCUMENTS

| | | | | |
|---|---|---|---|---|
| 4,042,193 | A | 8/1977 | Cerne | |
| 5,179,595 | A * | 1/1993 | Pollet | H04R 9/045 381/114 |
| 5,721,401 | A | 2/1998 | Sim | |
| 5,940,522 | A | 8/1999 | Cahill et al. | |
| 6,243,479 | B1 | 6/2001 | Proni | |
| 6,373,957 | B1 | 4/2002 | Stewart | |
| 6,639,993 | B2 | 10/2003 | Kemmerer et al. | |
| 7,711,134 | B2 | 5/2010 | Stead et al. | |
| 7,831,059 | B1 | 11/2010 | Sahyoun | |
| 8,204,269 | B2 | 6/2012 | Sahyoun | |
| 2004/0131219 | A1 * | 7/2004 | Polk, Jr. | H04R 1/2826 381/345 |
| 2005/0058315 | A1 * | 3/2005 | Poling | H04R 1/2826 381/337 |
| 2005/0094837 | A1 * | 5/2005 | Parker | H04R 9/022 381/355 |
| 2005/0265570 | A1 | 12/2005 | Isotalo | |
| 2007/0154056 | A1 | 7/2007 | Proni | |
| 2012/0033843 | A1 * | 2/2012 | Ouweltjes | H04R 9/022 381/349 |

OTHER PUBLICATIONS

Office Action for U.S. Appl. No. 14/605,129 dated May 25, 2016.

* cited by examiner

*Primary Examiner* — Matthew A Eason
(74) *Attorney, Agent, or Firm* — Brooks Kushman P.C.

(57) ABSTRACT

A loudspeaker system is provided including an enclosure and a transducer mounted within the enclosure. A port is provided in the enclosure, the port having an inlet located at an external surface of the enclosure and an outlet located in an interior of the enclosure which allow bi-directional air flow in and out of the enclosure. At least one duct is provided in the port to extract air flow from the port and redirect the air flow within the enclosure. In one embodiment, the at least one duct may comprise a NACA duct.

19 Claims, 3 Drawing Sheets

VENTED LOUDSPEAKER SYSTEM WITH DUCT FOR COOLING OF INTERNAL COMPONENTS

TECHNICAL FIELD

Embodiments relate to vented loudspeaker systems with one or more ducts for cooling of internal components.

BACKGROUND

There are many types of speaker enclosures, and each enclosure type can affect how sound is produced by the speaker. A transducer is mounted within the speaker enclosure, the transducer having a vibrating diaphragm for emitting sound waves in front of the diaphragm. As the diaphragm moves back and forth, rear waves are created behind the diaphragm as well. Many speakers take advantage of these rear waves to supplement forward sound waves produced by the diaphragm. In vented enclosures, the enclosure has a port, and the backward motion of the diaphragm excites the resonance created by the spring of air inside the speaker enclosure and the air contained within the port. The length and area of the port are generally sized to tune this resonant frequency.

Typically, current vented loudspeaker systems do not utilize the port as a source for cooling of internal speaker structures. In some cases, heat sensitive internal components may be placed in the vicinity of the port internal opening so that the high air velocity generated by the port at system resonance can offer additional convective cooling. However, this is difficult to do since these components must be placed far enough away not to disturb the port air flow, thus minimizing the cooling. Often, it is simply impractical to mount the components near the port opening.

SUMMARY

In one embodiment, a loudspeaker system includes an enclosure and a transducer mounted within the enclosure. A port is provided in the enclosure, the port having an inlet located at an external surface of the enclosure and an outlet located in an interior of the enclosure which allow bi-directional air flow in and out of the enclosure. At least one duct is provided in the port to extract air flow from the port and redirect the air flow within the enclosure.

In another embodiment, a loudspeaker system includes an enclosure and a transducer mounted within the enclosure. A port is provided in the enclosure, the port having an inlet located at an external surface of the enclosure and an outlet located in an interior of the enclosure which allow bi-directional air flow in and out of the enclosure. At least one duct is provided in the port to extract air flow from the port, the duct having an inlet formed in an internal surface of the port and an outlet. A conduit is operably connected between the duct outlet and an internal component of the loudspeaker system to redirect the air flow from the port for cooling of the internal component.

In another embodiment, a loudspeaker system includes an enclosure and a transducer mounted within the enclosure. A port is provided in the enclosure, the port having an inlet located at an external surface of the enclosure and an outlet located in an interior of the enclosure which allow bi-directional air flow in and out of the enclosure. At least one NACA duct is provided in the port to extract air flow from the port and redirect the air flow within the enclosure.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
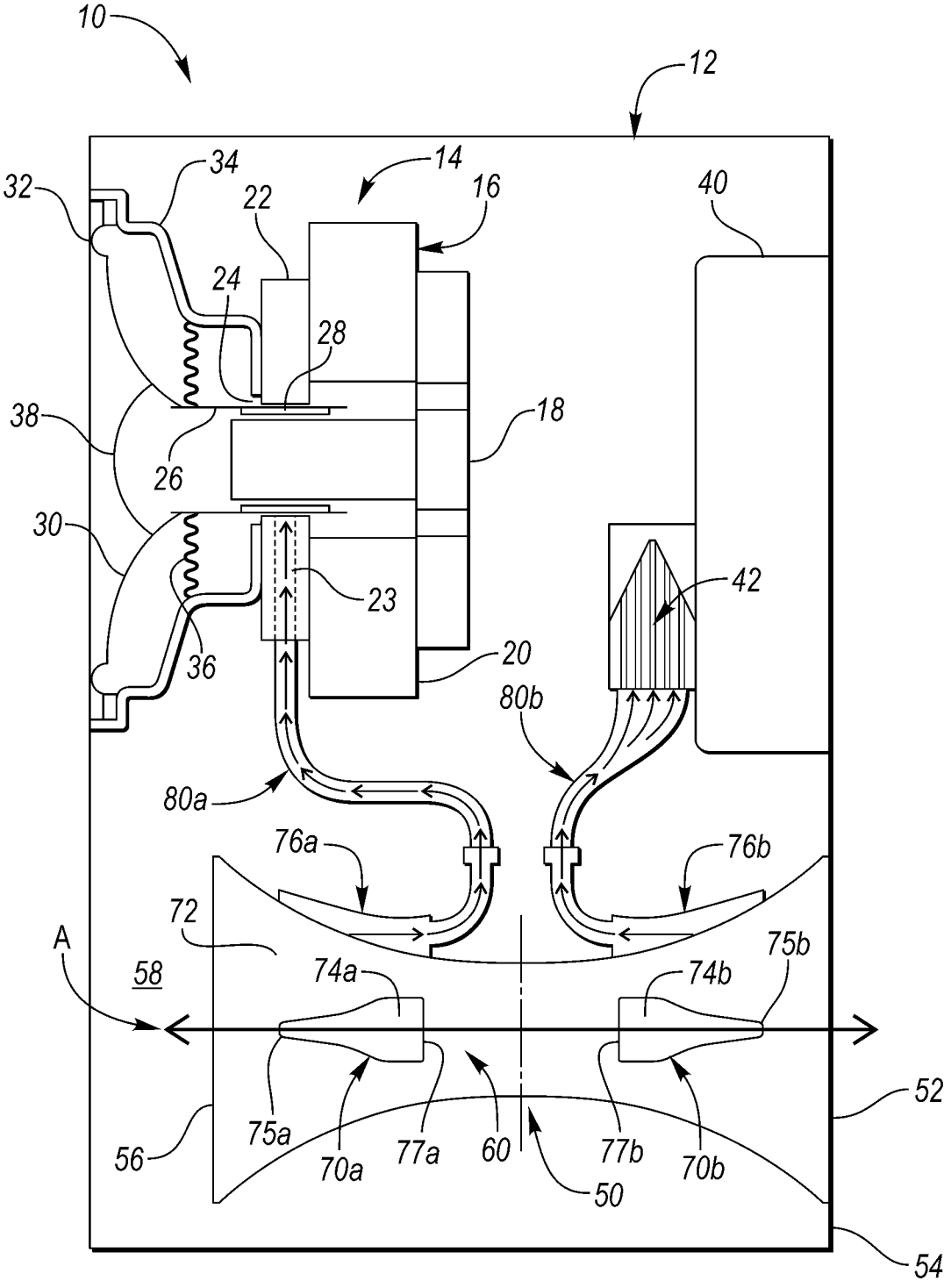
FIG. 1 is a cross-sectional view of a vented loudspeaker system with ducts provided in the port.

With reference to the cross-sectional view of FIG. 1, a loudspeaker system 10 includes an enclosure 12 and a speaker or transducer 14 positioned within the enclosure 12. As is known in the art, the speaker 14 may include a motor assembly 16 having a back plate and/or center pole 18, a permanent magnet 20, and a front or top plate 22 that may provide a substantially uniform magnetic field across an air gap 24. A voice coil former 26 may support a voice coil 28 in the air gap 24.

The speaker 14 may also include a diaphragm or cone 30, wherein a portion of the diaphragm 30 may be coupled with an end of the voice coil former 26. An outer end of the diaphragm 30 may be coupled to a surround 32 which, in turn, may be coupled at an outer perimeter to a frame or basket 34. A spider 36 may be coupled to the basket 34 and may include a central opening to which the voice coil former 26 is coupled. In other examples, the diaphragm 30 may be coupled with the voice coil former 26 via the spider 36 or any other component of the speaker 14. In addition, the speaker 14 may include a center cap or dust dome 38 that is designed to keep dust or other particulars out of the motor assembly 16.

The loudspeaker system 10 may also include additional internal components such as, but not limited to, an amplifier 40 disposed within the enclosure 12. During operation, current from the amplifier 40 or some other device supplying electrical signals representing program material to be transduced by the speaker 14 may drive the voice coil 28. Axial reciprocation of the voice coil 28 in the air gap 24 in connection with the diaphragm 30 generates sound representing the program material transduced by the speaker 14. Other speaker components may alternatively or additionally be included in the loudspeaker system 10.

A vent or port 50 is disposed on a rear portion of the enclosure 12, opposite the transducer diaphragm 30, although this illustrated placement is not intended to be limiting and the port 50 may disposed at another location on the enclosure 12. The port 50 has an inlet 52 located at an external surface 54 of the enclosure 12, and an outlet 56 located in an interior 58 of the enclosure 12. In the embodiment depicted, the port 50 has a flared configuration, such that the inlet 52 and the outlet 56 have a greater diameter or cross-sectional area than a central portion 60 of the port 50, although it is understood that the port 50 is not limited to this geometry. For example, a cylindrical port of uniform diameter could alternatively be used. Furthermore, although only one port 50 is shown, additional ports 50 may be included in the loudspeaker system 10.

Figure 2:
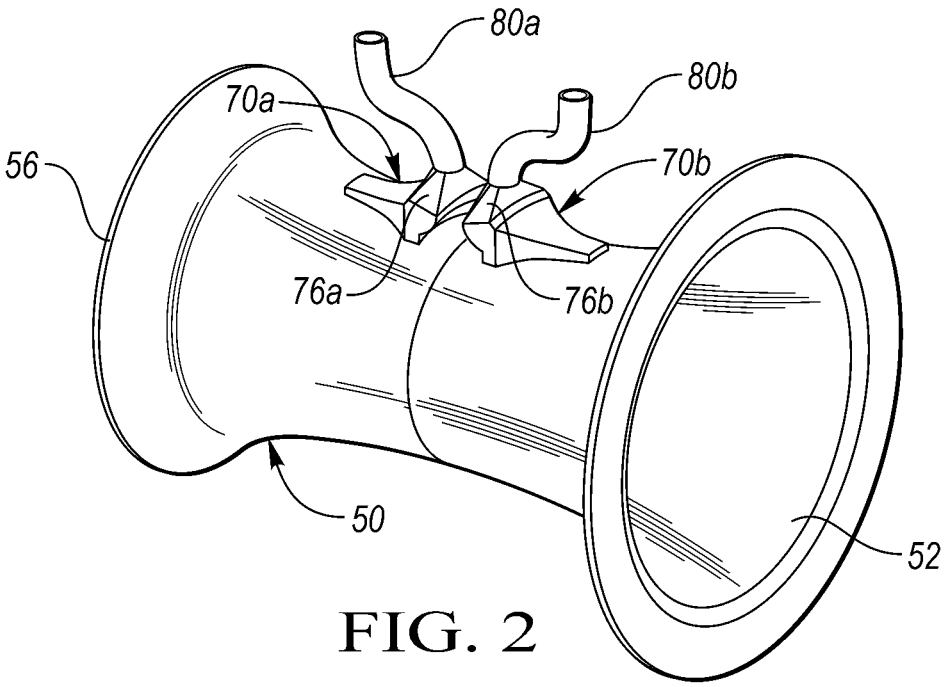
FIG. 2 is a perspective view of the port showing the ducts and conduit connections.
Figure 3:
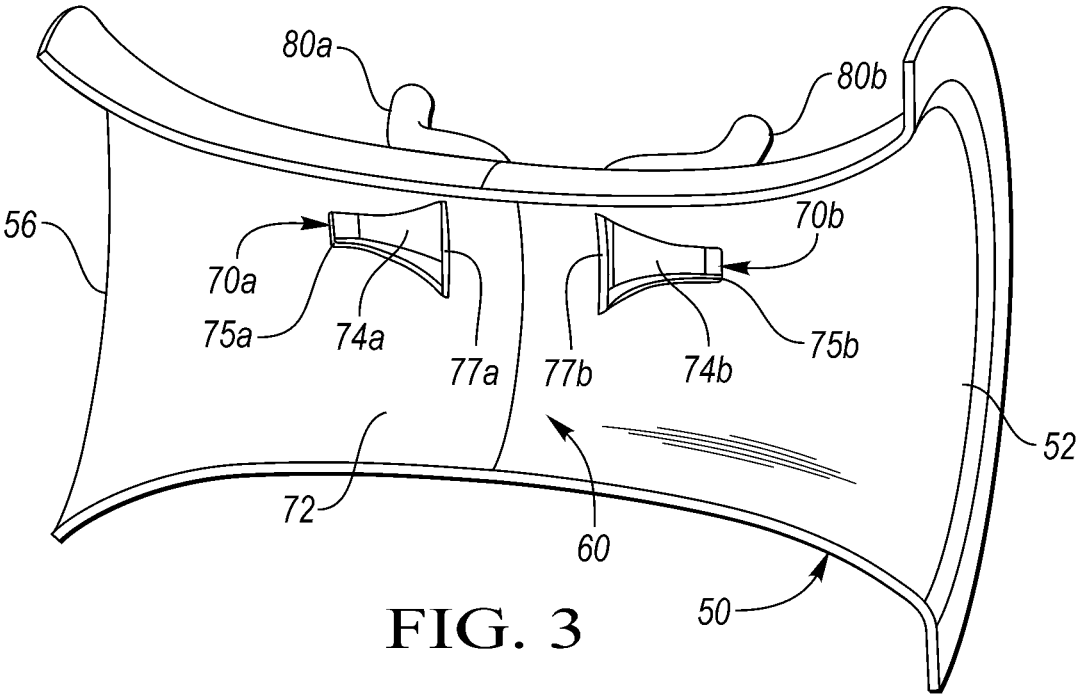
FIG. 3 is a cutaway view of the port interior showing the duct inlets.

The port 50, which may be referred to as a Helmholtz port, in a vented loudspeaker system 10 is a source of high velocity, bi-directional air flow in and out of the inlet 52 and outlet 56, as indicated by the arrow A in FIG. 1. As shown in FIGS. 1-3, one or more ducts 70 may be provided on an interior surface 72 of the port 50 for directing air flow from the port 50 into other parts of the enclosure 12. In one embodiment, the ducts 70 may comprise NACA ducts, also known as NACA (National Advisory Committee for Aeronautics) scoops or submerged inlets. NACA ducts may be used to extract air at the surface inlet with minimal disruption to laminar air flow and coefficient of drag. As is known in the art, a NACA submerged inlet duct utilizes a special geometry from a front 75 to a rear 77 of the duct which improves the pressure recovery. In one embodiment, an optimum NACA duct design may employ curved diverging ramp walls with a width to depth ratio between about 3 and 5, and a ramp angle of between about 5 and 7 degrees. In one embodiment, an entrance lip at the back 77 of the duct may have a blunt airfoil leading edge shape. Although NACA-type ducts 70 are shown and described herein, it is understood that other duct configurations which extract air flow from the port 50 and direct the air flow elsewhere within the loudspeaker enclosure 12 are also fully contemplated.

The specific divergent geometry of the NACA duct 70 scavenges boundary-layer air from the air flowing in the port 50 created from Helmholtz resonance and related to the AC displacement of the transducer diaphragm 30, and directs the air toward any internal component of the loudspeaker system 10 which may benefit from or require direct forced air cooling. Although the Helmholtz port 50 may only operate over a narrow low frequency bandwidth dictated by the tuning frequency of the loudspeaker system 10, it may supply supplemental cooling of internal system components to improve power handling and output, such as in powered subwoofer applications.

In one embodiment, the air flow may be channeled from the ducts 70 through connected conduits 80 to interface with internal system components. For example, in the embodiment depicted in FIG. 1, a first duct 70*a* may be operably connected to the transducer voice coil 28, such as via a first conduit 80*a* connected between the first duct 70*a* and a channel 23 within the transducer top plate 22 to provide direct convective cooling to the voice coil 28 and other components of the transducer 14. In another example, a second duct 70*b* may be operably connected to the system amplifier 40, which may be accomplished via a second conduit 80*b* connected between a second duct 70*b* and the amplifier 40, such as to a heat-sink component 42. Of course, the number and location of the ducts 70 and conduits 80 is merely exemplary, and other configurations and locations are also contemplated depending on the application and how much air flow or cooling is desired. Furthermore, in another embodiment, the duct outlets 76 could be connected directly to internal electronic components for transferring cooling air from the port 50 to the components without the use of conduits 80.

NACA ducts may operate by scavenging slower moving air at the surface, while greatly minimizing turbulence and drag at the inlet 74. In doing so, the NACA duct 70 does not disturb the laminar flow of the passing air. The length and shape of the NACA duct 70 may also create counter-rotating vortices that deflect the boundary layer away from the inlet 74 but draw in the fast moving air above it. The carefully optimized dimensions and divergent side wall and sloped floor geometry of the NACA duct 70 allow it to work with the boundary layer of slower moving air and direct it towards the duct outlet 76. In any event, the NACA duct 70 is efficiently diverting air flow out of the Helmholtz port 50, and optionally into the conduit 80, with minimal impact to air flow in the port 50. Given the high velocity of bi-directional air traveling through the port 50, the NACA duct 70 may then help minimize extraneous port noise and acoustic losses.

As illustrated in FIGS. 1-3, in one embodiment the ducts 70 may be equally spaced along the interior surface 72 with respect to the inlet 52 and outlet 56 of the port 50 for approximately even distribution of air flow. In addition, the NACA ducts 70 may be placed with the divergent geometry of their inlets 74 oriented in alternating, opposite or mirror image directions relative to the bi-directional air flow A in the port 50. As best shown in FIGS. 1 and 3, the opposing configuration may include the duct fronts 75*a* and 75*b* oriented toward the port outlet 56 and the port inlet 52, respectively, and the duct backs 77*a* and 77*b* oriented toward each other and toward the central portion 60 of the port 50. This configuration may offer a more continuous forced air stream for cooling of the internal system components.

Figure 4:
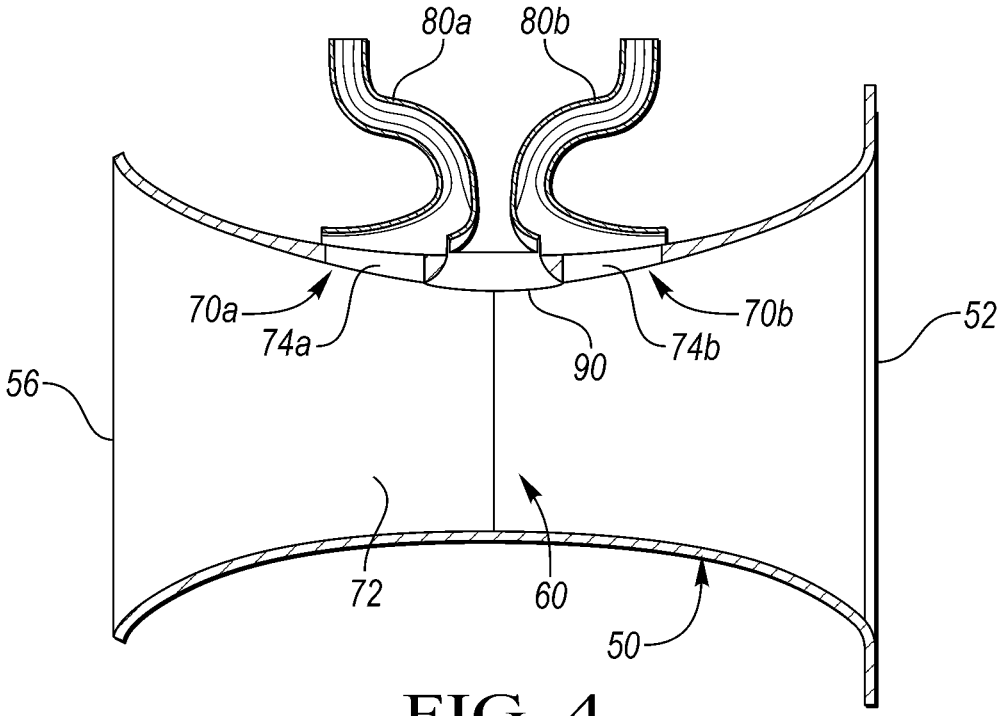
FIG. 4 is a cross-sectional view of an embodiment of a port wherein the duct inlets are provided on a raised portion of the duct interior surface.
Figure 5:
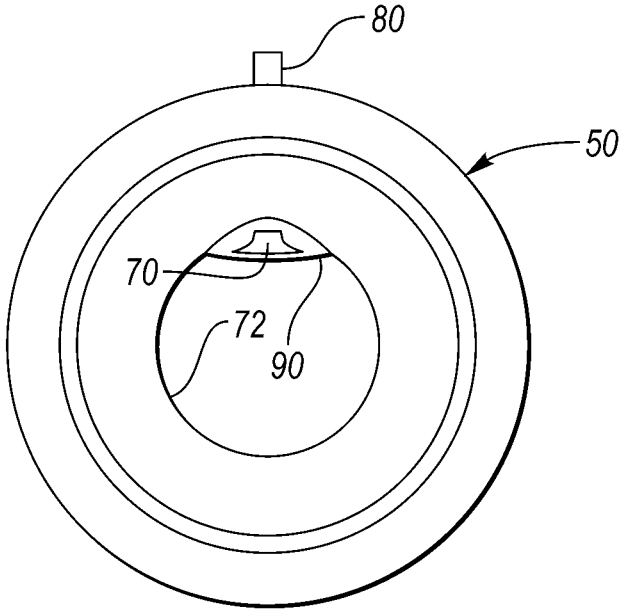
FIG. 5 is an end view through the port embodiment of FIG. 4.

Helmholtz ports 50 typically have angled or flared walls, diverging from the center portion 60 toward along the port length toward the duct inlet 52 and duct outlet 56. In this instance, the NACA duct 70 may be placed on a sloping surface of the flared port 50, creating a positive pressure gradient near the inlet 74 and thus improving its operation. In another embodiment, raising the NACA duct 70 so that it is above the boundary layer may increase the pressure recovery or air flow. With reference to FIGS. 4 and 5, this may be done by placing the duct 70 on a slightly raised bump or contour 90 that protrudes above the port interior surface 72. In the embodiment shown, the contour 90 extends from the first duct 70*a* to the second duct 70*b* through the central portion 60 of the port 50, although the contour 90 is not limited to this configuration. The height of the contour 90 may be selected to optimize the increase in air flow gained into the ducts 70*a*, 70*b* with respect to any disruption in laminar air flow of air passing through the port 50.

The duct 70 could be created in the port 50 by way of high temperature plastic molding and either inserted onto the existing Helmholtz port interior surface 72 as a separate part, or the duct 70 could be molded as one piece with the duct 50. A metal casting part could also be used having the same one- or two-piece arrangement. The conduits 80 may likewise have a plastic or metallic construction. Loudspeaker systems utilizing the duct configuration described herein may benefit from higher power handling and power ratings due to improved convective cooling of internal components.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker system, comprising:

an enclosure;

a transducer mounted within a front portion of the enclosure;

a port provided in the enclosure, the port having an inlet located at an external surface of a rear portion of the enclosure opposite the transducer, and an outlet located in an interior of the enclosure which allow bi-directional air flow in and out of the enclosure;

at least one duct provided in the port to extract air flow from the port and redirect the air flow within the enclosure; and a conduit operably connected between the at least one duct and an internal component of the loudspeaker system.

2. The loudspeaker system of claim 1, wherein the at least one duct includes a first duct and a second duct, the first and second ducts equally spaced from the port outlet and the port inlet, respectively.

3. The loudspeaker system of claim 1, wherein the at least one duct comprises a NACA duct.

4. The loudspeaker system of claim 3, wherein the at least one duct comprises two NACA ducts oriented in opposing directions, wherein a front of each duct is oriented toward one of the port outlet and the port inlet, and a back of each duct is oriented toward a central portion of the port.

5. The loudspeaker system of claim 1, wherein the internal component includes a transducer voice coil.

6. The loudspeaker system of claim 5, wherein the transducer includes a motor assembly having a top plate with a channel provided therein, and the conduit is connected to the top plate channel to provide convective cooling for the transducer voice coil.

7. The loudspeaker system of claim 1, wherein the internal component includes an amplifier.

8. The loudspeaker system of claim 1, wherein the port has a flared configuration such that the inlet and the outlet have a greater diameter than a central portion of the port.

9. The loudspeaker system of claim 1, wherein the at least one duct is formed in a raised contour protruding above an interior surface of the port.

10. A loudspeaker system, comprising:

an enclosure;

a transducer mounted within the enclosure;

a port provided in the enclosure, the port having an inlet located at an external surface of the enclosure and an outlet located in an interior of the enclosure which allow bi-directional air flow in and out of the enclosure;

at least one duct provided in the port to extract air flow from the port, the at least one duct having an inlet formed in an internal surface of the port and an outlet; and a conduit operably connected between the duct outlet and an internal component of the loudspeaker system to redirect the air flow from the port for cooling of the internal component.

11. The loudspeaker system of claim 10, wherein the at least one duct includes a first duct and a second duct, the first and second ducts equally spaced from the port outlet and the port inlet, respectively.

12. The loudspeaker system of claim 10, wherein the at least one duct comprises a NACA duct.

13. The loudspeaker system of claim 12, wherein the at least one duct comprises two NACA ducts oriented in opposing directions, wherein a front of each duct is oriented toward one of the port outlet and the port inlet, and a back of each duct is oriented toward a central portion of the port.

14. The loudspeaker system of claim 10, wherein the internal component includes at least one of a transducer voice coil and an amplifier.

15. A loudspeaker system, comprising:

an enclosure;

a transducer mounted within the enclosure;

a port provided in the enclosure, the port having an inlet located at an external surface of the enclosure and an outlet located in an interior of the enclosure which allow bi-directional air flow in and out of the enclosure; and at least one NACA duct provided in the port to extract air flow from the port and redirect the air flow within the enclosure.

16. The loudspeaker system of claim 15, wherein the at least one NACA duct includes a first NACA duct and a second NACA duct, the first and second NACA ducts equally spaced from the port outlet and the port inlet, respectively.

17. The loudspeaker system of claim 16, wherein the first and second NACA ducts are oriented in opposing directions, wherein a front of each NACA duct is oriented toward one of the port outlet and the port inlet, and a back of each NACA duct is oriented toward a central portion of the port.

18. The loudspeaker system of claim 15, further comprising a conduit operably connected between the at least one NACA duct and an internal component of the loudspeaker system.

19. The loudspeaker system of claim 18, wherein the internal component includes at least one of a transducer voice coil and an amplifier.

* * * * *